US006581211B1

(12) United States Patent
Golden

(10) Patent No.: US 6,581,211 B1
(45) Date of Patent: Jun. 24, 2003

(54) MITTEN

(76) Inventor: Jeffrey Golden, 38 Main St., Little Ferry, NJ (US) 07643

( * ) Notice: Subject to any disclaimer, the term of this patent is extended or adjusted under 35 U.S.C. 154(b) by 0 days.

(21) Appl. No.: 10/177,325

(22) Filed: Jun. 24, 2002

(51) Int. Cl.[7] ..... A41D 25/00
(52) U.S. Cl. ..... 2/158
(58) Field of Search ..... 2/158, 159, 161.5, 2/161.6, 163, 161.4, 910, 917

(56) References Cited

U.S. PATENT DOCUMENTS

| | | | | | |
|---|---|---|---|---|---|
| 428,115 | A | * | 5/1890 | Levy | 2/158 |
| 480,852 | A | * | 8/1892 | Kahn | 2/158 |
| 1,275,837 | A | * | 8/1918 | Biggs | 2/158 |
| 1,283,548 | A | * | 11/1918 | O'Reilly | 2/158 |
| 1,310,120 | A | * | 7/1919 | Kreamer | 2/158 |
| 1,849,418 | A | * | 3/1932 | Chesebro | 2/158 |
| 2,274,335 | A | * | 2/1942 | Kennedy | 2/158 |
| 2,315,889 | A | * | 4/1943 | Wells | 2/158 |
| 2,323,136 | A | * | 6/1943 | Johanson | 2/158 |
| 3,299,441 | A | * | 1/1967 | Slimovitz | 2/158 |
| D207,442 | S | * | 4/1967 | Facci | D2/616 |
| 5,867,830 | A | * | 2/1999 | Chen | 2/161.1 |
| 6,338,163 | B1 | * | 1/2002 | Markson | 2/163 |

* cited by examiner

*Primary Examiner*—Garry L. Welch
(74) *Attorney, Agent, or Firm*—Charles E. Baxley

(57) ABSTRACT

A mitten that includes a body that has a form and a texture of that of an animal (e.g. bear) paw. The body covers a hand and has a combined thumb/finger-covering portion and a slot. The body is configured so as to allow the thumb and the fingers of the hand to exit from the combined thumb/finger-covering portion thereof and still remain completely in the body while the body is still donned normally on the hand. The slot in the body allows the thumb and the fingers of the hand to exit therefrom while the body is still donned on the hand, once the thumb and the fingers of the hand have exited from the combined thumb/finger-covering portion of the body, so as to expose the thumb and the fingers of the hand and allow unrestricted use of the thumb and the fingers of the hand while the body is still donned on the hand without having to undonne the body from the hand.

9 Claims, 4 Drawing Sheets

MITTEN

BACKGROUND OF THE INVENTION

1. Field of the Invention

The present invention relates to a mitten. More particularly, the present invention relates to a mitten which accommodates ease of finger manipulations.

2. Description of the Prior Art

Gloves and mittens are commonly worn to protect a wearer's hand while engaging in cold weather outdoor activities, such as skiing, and are, of necessity, somewhat bulky. Because of the cumbersome nature of most gloves and mittens, it is often difficult to make fine manual or digital manipulations, such as working zippers, applying ski lift tickets, or handling/eating food, without removing the gloves or mittens. Numerous variations on the basic glove/mitten design have been fashioned to deal with this problem, but none have fully addressed the problems at hand. While some of the numerous variations on the basic glove/mitten design provide some amount of increased dexterity, none afford the adroitness possible with both the thumb and fingers exposed.

It will be appreciated that many tasks, such as tying shoes or boots, reloading a gun, or writing, are much easier if both the thumb and fingers can be used without the impediment of an intervening glove. Simply removing the gloves to perform precision tasks is unacceptable because it would leave the hands completely exposed to the elements. Also, the wearer would have to hold, or find someplace to set, the removed gloves to free his or her hands. In addition, putting the gloves back on can be an awkward process, especially for the second glove.

Thus, there exists a need for a hand covering that allows for fine manual or digital manipulations of increasing dexterity of exposing both the thumb and fingers without undonning the hand covering.

SUMMARY OF THE INVENTION

ACCORDINGLY, AN OBJECT of the present invention is to provide a mitten that avoids the disadvantages of the prior art.

ANOTHER OBJECT of the present invention is to provide a mitten that is simple to use.

BRIEFLY STATED, STILL ANOTHER OBJECT of the present invention is to provide a mitten that includes a body that has a form and a texture of an animal's (e.g. bear) paw. The body covers a hand and has a combined thumb/finger-covering portion and a slot. The body is configured so as to allow the thumb and the fingers of the hand to exit from the combined thumb/finger-covering portion thereof and still remain completely in the body while the body is still donned normally on the hand. The slot in the body allows the thumb and the fingers of the hand to exit therefrom while the body is still donned on the hand, once the thumb and the fingers of the hand have exited from the combined thumb/finger-covering portion of the body, so as to expose the thumb and the fingers of the hand and allow unrestricted use of the thumb and the fingers of the hand while the body is still donned on the hand without having to undonne the body from the hand.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
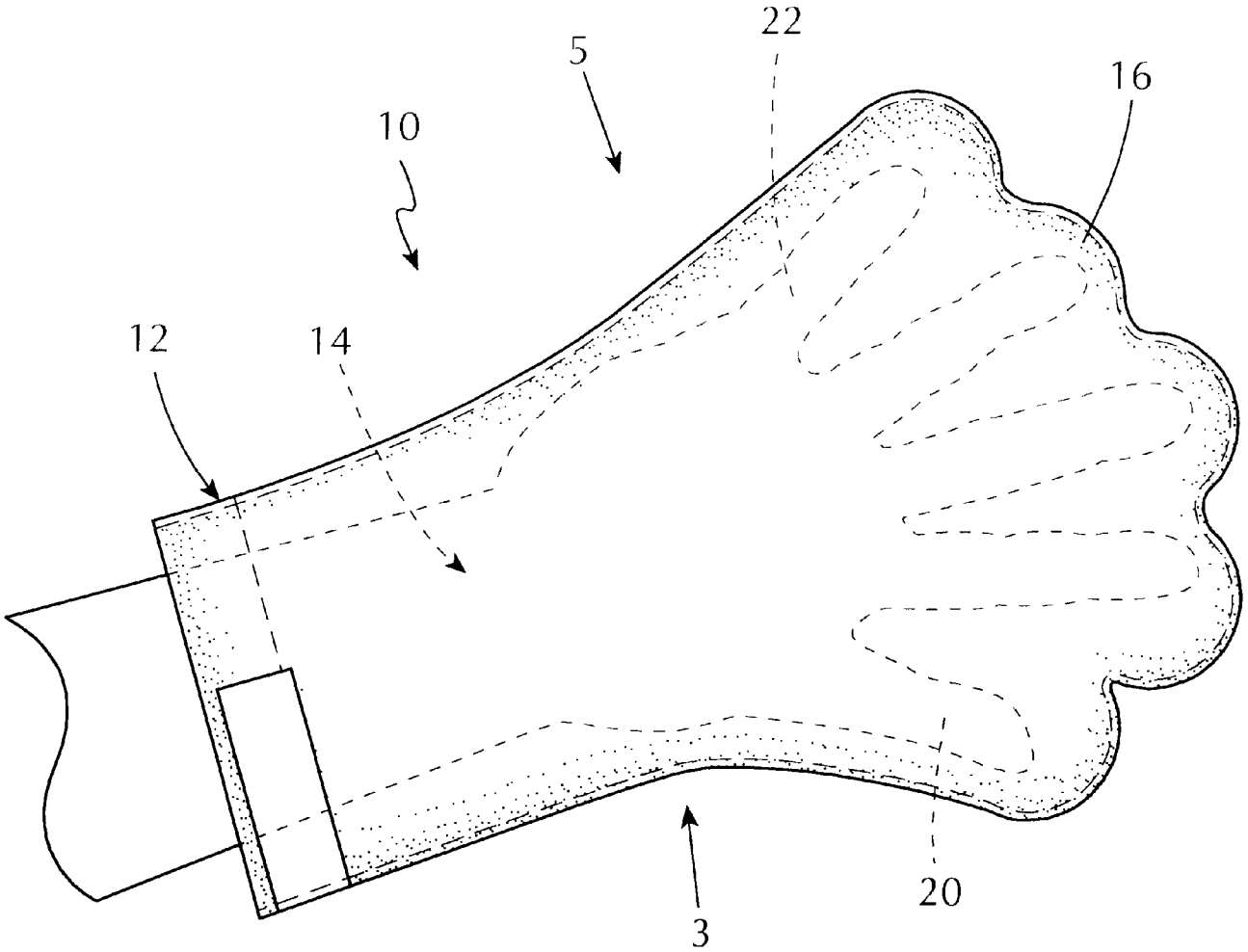
FIG. 1 is a diagrammatic perspective view of the mitten of the present invention in use donned normally on a hand.

10 mitten of present invention
12 body for covering hand 14 and configured for allowing thumb 20 and fingers 22 of hand 14 to exit from combined thumb/finger-covering portion 16 of body 12 and still remain completely in body 12 while body 12 is still donned normally on hand 14
14 hand
16 combined thumb/finger-covering portion of body 12
18 slot in body 12 for allowing thumb 20 and fingers 22 of hand 14 to exit therefrom while wrist-covering portion 34 of body 12 is still donned on hand 14, once thumb 20 and fingers 22 of hand 14 have exited from combined thumb/finger-covering portion 16 of body 12, so as to expose thumb 20 and fingers 22 of hand 14 and allow unrestricted use of thumb 20 and fingers 22 of hand 14 while body 12 is still donned on hand 14 without having to undonne body 12 from hand 14
20 thumb of hand 14
22 fingers of hand 14
24 first edge defining slot 18 in body 12
26 second edge defining slot 18 in body 12
28 first portion of hook and loop fasteners along first edge 24 defining slot 18 in body 12
30 second portion of hook and loop fasteners along second edge 26 defining slot 18 in body 12
32 palm-covering portion of body 12
34 wrist-covering portion of body 12
36 strap of body 12
38 third portion of hook and loop fasteners along strap 36 of body 12
40 fourth portion of hook and loop fasteners along portion of wrist-covering portion 34 of body 12

DETAILED DESCRIPTION OF THE PREFERRED EMBODIMENT

Figure 2:
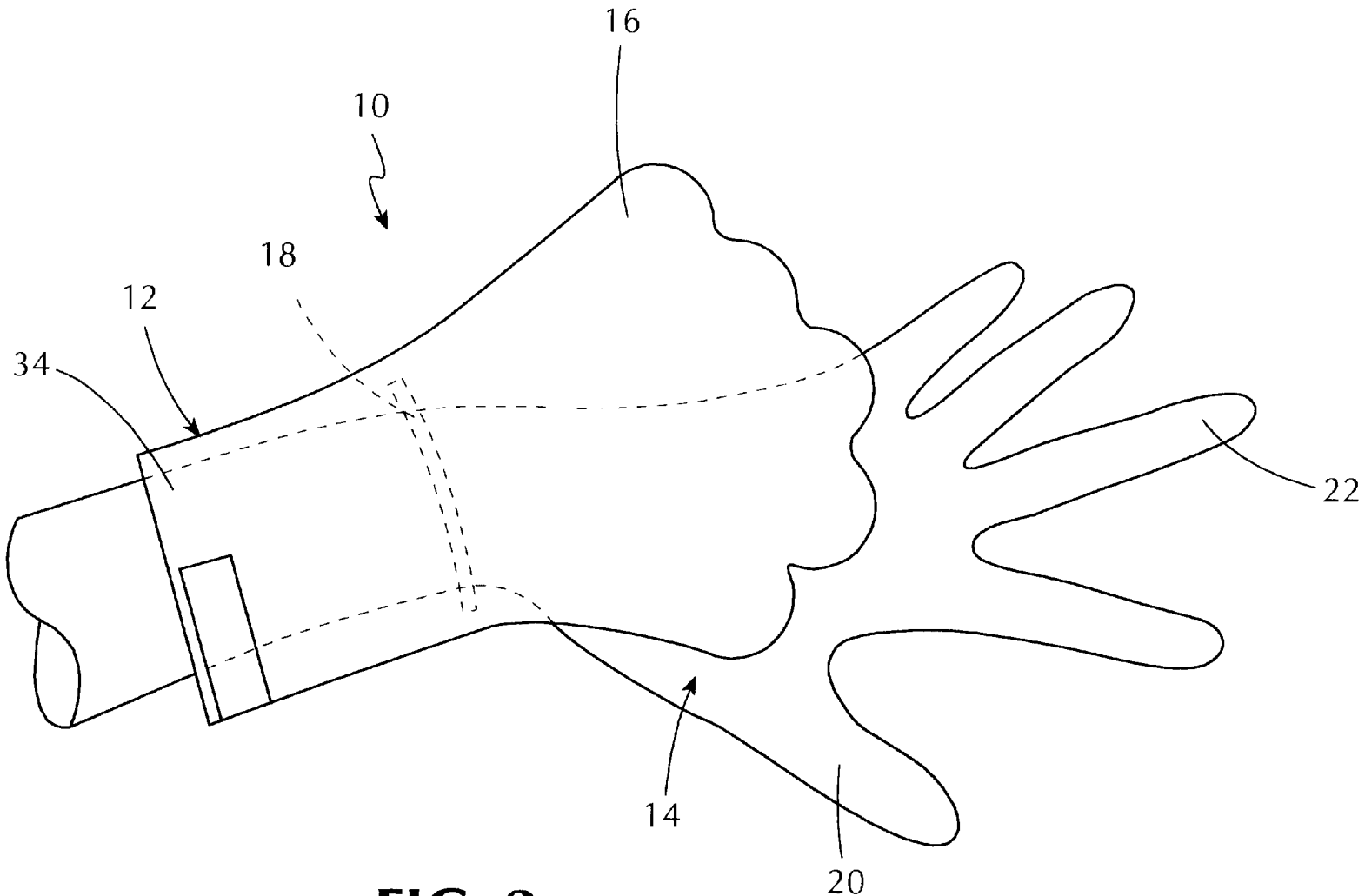
FIG. 2 is a diagrammatic perspective view of the mitten of the present invention in use donned on a hand with the thumb and fingers of the hand exited therefrom.

Referring now to the figures, in which like numerals indicate like parts, and particularly to FIGS. 1 and 2, which are, respectively, a diagrammatic perspective view of the mitten of the present invention in use donned normally on a hand, and a diagrammatic perspective view of the mitten of the present invention in use donned on a hand with the thumb and fingers of the hand exited therefrom, the mitten of the present invention is shown generally at 10.

Figure 4:
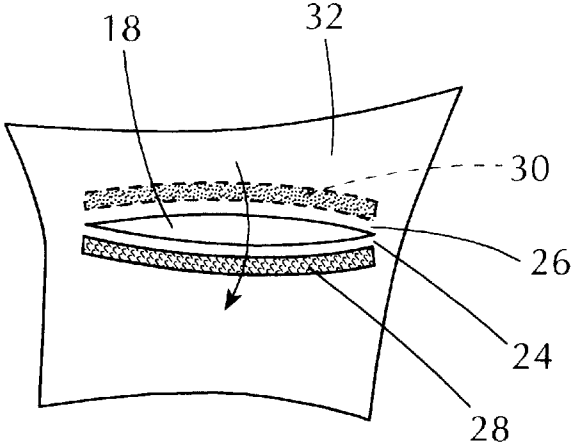
FIG. 4 is a diagrammatic fragmented view of the area generally enclosed by the dotted curve identified by ARROW 4 in FIG. 3 of a longitudinally disposed slot.
Figure 3:
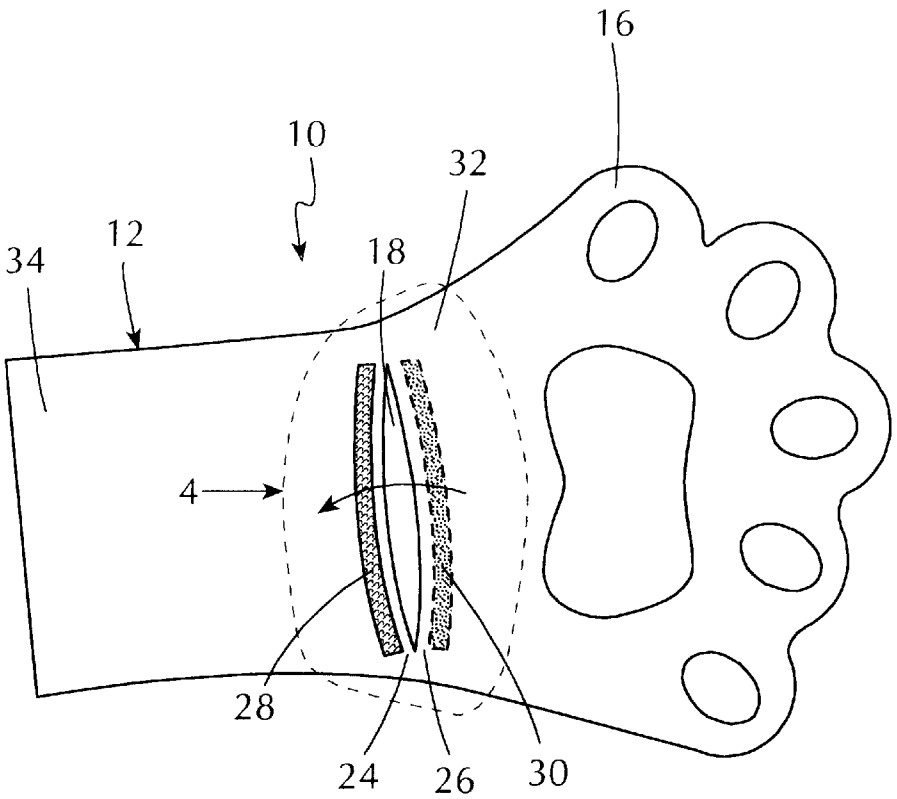
FIG. 3 is a diagrammatic bottom plan view taken generally in the direction of ARROW 3 in FIG. 1 of the mitten of the present invention with a laterally disposed slot.
Figure 5:
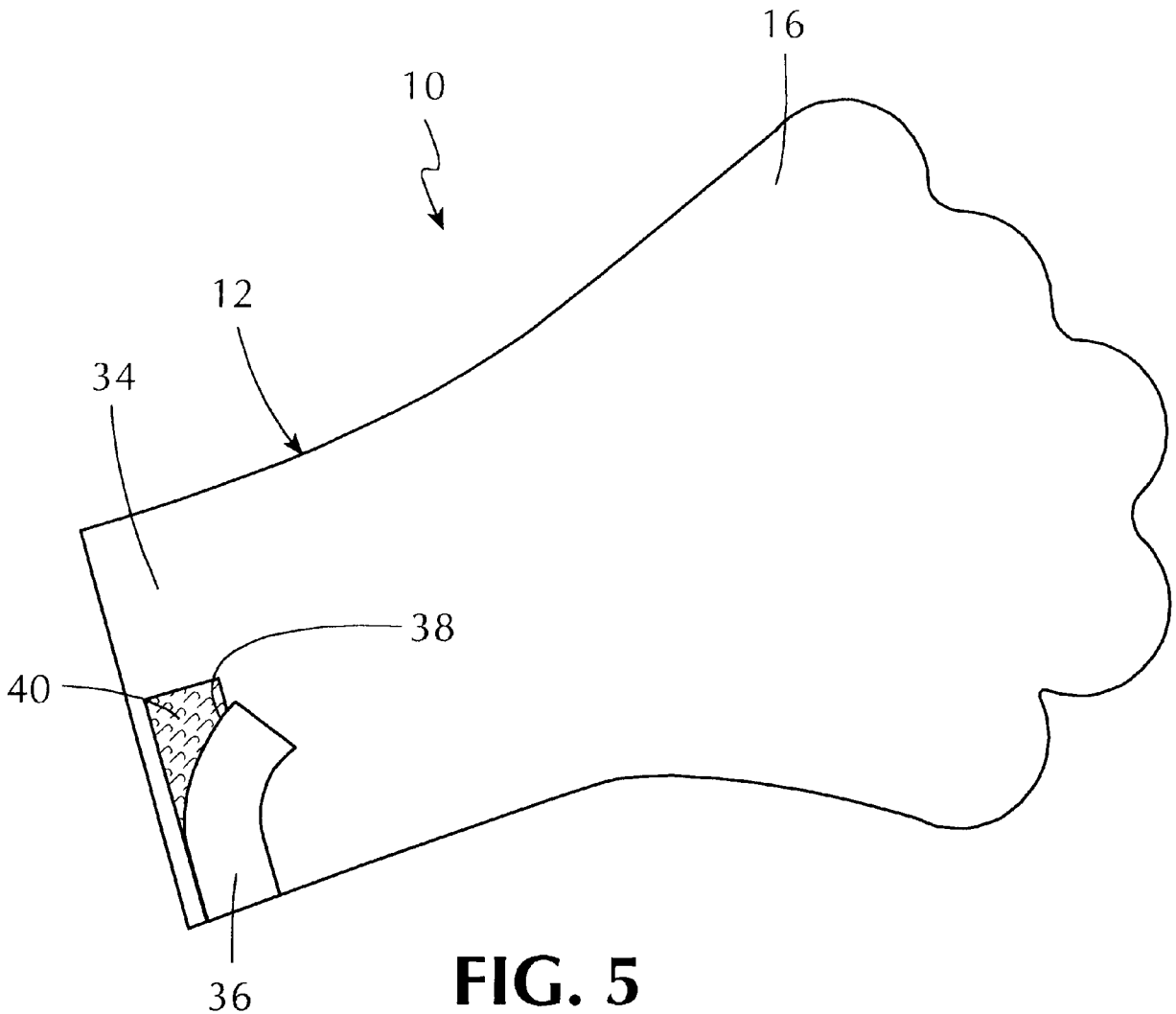
FIG. 5 is a diagrammatic top plan view taken generally in the direction of ARROW 5 in FIG. 1.

The configuration of the mitten 10 can best be seen in FIGS. 3 to 5, which are, respectively, a diagrammatic bottom plan view taken generally in the direction of ARROW 3 in FIG. 1 of the mitten of the present invention with a laterally disposed slot, a diagrammatic fragmented view of the area generally enclosed by the dotted curve identified by ARROW 4 in FIG. 3 of a longitudinally disposed slot, and a diagrammatic top plan view taken generally in the direction of ARROW 5 in FIG. 1, and as such, will be discussed with reference thereto.

The mitten 10 includes a body 12 that covers a hand 14 (see FIG. 1) and has a form and a texture of that of an animal (e.g. bear) paw, a combined thumb/finger-covering portion 16, and a slot 18. The body 12 is configured to allow the thumb 20 and the fingers 22 of the hand 14 to exit from the combined thumb/finger-covering portion 16 of the body 12 and still remain completely in the body 12 while the body 12 is still donned normally on the hand 14.

The slot 18 in the body 12 allows the thumb 20 and the fingers 22 of the hand 14 to exit therefrom while the body 12 is still donned on the hand 14, once the thumb 20 and the fingers 22 of the hand 14 have exited from the combined thumb/finger-covering portion 16 of the body 12, so as to expose the thumb 20 and the fingers 22 of the hand 14 and allow unrestricted use of the thumb 20 and the fingers 22 of the hand 14 while the body 12 is still donned on the hand 14 without having to undonne the body 12 from the hand 14 (see FIG. 2).

The slot 18 has to be only slender, elongated, and straight since the thumb 20 and the fingers 22 of the hand 14 do not require a large area to exit the body 12 since the thumb 20 and the fingers 22 of the hand 14 can exit from the combined thumb/finger-covering portion 16 of the body 12 and still remain completely in the body 12 before the thumb 20 and the fingers 22 of the hand 14 have to exit from the slot 18 in the body 12.

As shown in FIG. 3, the slot 18 in the body 12 is defined by a first edge 24 and a second edge 26 that overlaps the first edge 24. The first edge 24 has a first portion of hook and loop fasteners 28 therealong and the second edge 26 has a second portion of hook and loop fasteners 30 therealong that selectively mates with the first portion of hook and loop fasteners 28 so as to selectively close the slot 18 in the body 12.

The body 12 further has a palm-covering portion 32 through which the slot 18 extends laterally, and a wrist-covering portion 34 with a size. Alternatively, as shown in FIG. 4, the slot 18 extends longitudinally. The slot 18 in the body 12 allows the thumb 20 and the fingers 22 of the hand 14 to exit therefrom while the body 12 is still donned on the wrist-covering portion 34 of the body 12 so as to expose the thumb 20 and the fingers 22 of the hand 14 and allow unrestricted use of the thumb 20 and the fingers 22 of the hand 14 while the body 12 is still donned on the hand 14 without having to undonne the body 12 from the hand 14 (see FIG. 2).

As shown in FIG. 5, the body 12 further has a strap 36 that extends across a portion of the wrist-covering portion 34 of the body 12. The strap 36 of the body 12 has a third portion of hook and loop fasteners 38 therealong and the portion of the wrist-covering portion 34 has a fourth portion of hook and loop fasteners 40 therealong that selectively mates with the third portion of hook and loop fasteners 38 so as to allow the strap 36 to adjust the size of the wrist-covering portion 34 of the body 12.

It will be understood that each of the elements described above, or two or more together, may also find a useful application in other types of constructions differing from the types described above.

While the invention has been illustrated and described as embodied in a mitten, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A mitten, comprising a body;

wherein said body is for covering a hand;

wherein said body has a combined thumb/finger-covering portion;

wherein said body is configured for allowing the thumb and the fingers of the hand to exit from said combined thumb/finger-covering portion thereof and still remain completely in said body while said body is still donned normally on the hand;

wherein said body has a palm-covering portion;

wherein said body has a wrist-covering portion;

wherein said body has a slot; and wherein said slot in said body is entirely disposed rearwardly adjacent said palm-covering portion of said body, directly rearwardly of said combined thumb/finger covering portion, but spaced forwardly from said wrist-covering portion of said body for allowing the thumb and the fingers of the hand to exit therefrom while said body is still donned on the hand, once the thumb and the fingers of the hand have exited from said combined thumb/finger-covering portion of said body, so as to expose the thumb and the fingers of the hand and allow unrestricted use of the thumb and the fingers of the hand while said body is still donned on the hand without having to undonne said body from the hand.

2. The mitten as defined in claim 1, wherein said body has a form;

wherein said body has a texture;

wherein said form of said body is that of an animal paw; and wherein said texture of said body is that of an animal paw.

3. The mitten as defined in claim 1, wherein said slot has to be only slender, elongated, and straight since the thumb and the fingers of the hand do not require a large area to exit said body since the thumb and the fingers of the hand can exit from said combined thumb/finger-covering portion of said body and still remain completely in said body before the thumb and the fingers of the hand have to exit from said slot in said body.

4. The mitten as defined in claim 1, wherein said slot is defined by a first edge;

wherein said slot is defined by a second edge;

wherein said second edge overlaps said first edge;

wherein said first edge has a first portion of hook and loop fasteners therealong;

wherein said second edge has a second portion of hook and loop fasteners therealong; and wherein said first portion of hook and loop fasteners selectively mates with said second portion of hook and loop fasteners so as to selectively close said slot in said body.

5. The mitten as defined in claim 1, wherein said slot extends longitudinally.

6. The mitten as defined in claim 1, wherein said slot extends laterally.

7. The mitten as defined in claim 1, wherein said slot in said body is for allowing the thumb and the fingers of the hand to exit therefrom while said body is still donned on said wrist-covering portion of said body so as to expose the thumb and the fingers of the hand and allow unrestricted use of the thumb and the fingers of the hand while said body is still donned on the hand without having to undonne said body from the hand.

8. The mitten as defined in claim 7, wherein said body has a strap; and wherein said strap extends across a portion of said wrist-covering portion.

9. The mitten as defined in claim 8, wherein said strap of said body has a third portion of hook and loop fasteners therealong;

wherein said portion of said wrist-covering portion has a fourth portion of hook and loop fasteners therealong;

wherein said wrist-covering portion of said body has a size; and wherein said third portion of hook and loop fasteners selectively mates with said fourth portion of hook and loop fasteners so as to allow said strap to adjust said size of said wrist-covering portion of said body.

* * * * *